US010287748B1

(12) United States Patent
Wetta

(10) Patent No.: US 10,287,748 B1
(45) Date of Patent: May 14, 2019

(54) DREDGE WALKING SPUD APPARATUS

(71) Applicant: DSC DREDGE, LLC, Reserve, LA (US)

(72) Inventor: William J. Wetta, Reserve, LA (US)

(73) Assignee: DSC DREDGE, LLC, Reserve, LA (US)

( * ) Notice: Subject to any disclaimer, the term of this patent is extended or adjusted under 35 U.S.C. 154(b) by 193 days.

(21) Appl. No.: 15/375,430

(22) Filed: Dec. 12, 2016

Related U.S. Application Data

(60) Provisional application No. 62/266,400, filed on Dec. 11, 2015.

(51) Int. Cl.
*E02F 9/06* (2006.01)
*E02F 9/20* (2006.01)
*E02F 9/22* (2006.01)

(52) U.S. Cl.
CPC ..... *E02F 9/062* (2013.01); *E02F 9/2016* (2013.01); *E02F 9/22* (2013.01)

(58) Field of Classification Search
CPC . E02F 9/062; E02F 9/2217; E02F 9/22; E02F 9/2016
See application file for complete search history.

(56) References Cited

U.S. PATENT DOCUMENTS 879,345 A * 2/1908 Wilson ..... E02F 9/062 37/346
1,792,065 A * 2/1931 Hogan ..... E02F 3/88 37/308
2,061,440 A * 11/1936 Schaefer ..... E02F 9/062 37/346
2,290,118 A * 7/1942 Page ..... B62D 57/00 180/8.5
2,731,741 A * 1/1956 Kaufmann ..... E02F 3/88 114/26
2,850,814 A * 9/1958 Ellicott, Jr. ..... E02F 3/905 37/331
2,917,851 A * 12/1959 Ellicott, Jr. ..... E02F 9/003 37/346
3,003,454 A * 10/1961 Shatoska ..... E02F 9/062 37/346
3,656,449 A * 4/1972 Mead ..... E02F 9/062 37/346
3,765,499 A * 10/1973 Harmala ..... B62D 57/00 180/8.5

(Continued)

*Primary Examiner* — Jessica H Lutz
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A dredge and spud apparatus provides a dredge or hull or floating tank. The hull supports one or more spuds. An interface mounts each spud to the hull. The interface includes a frame attached to the hull and a carriage supported by the frame for movement between a forward position and a rear position. The hull can support one or more dredge components. The hull can be a barge. The carriage can be moved from the forward position to the rear position (or from the rear position to the forward position) in order to change position of the hull or floating tank relative to the spuds when the spuds are anchored to the water bed, sea bed, lake bed, river bed, etc. The interface includes inner and outer links, at least one link being powered to move between forward and rear positions.

22 Claims, 4 Drawing Sheets

(56) References Cited

U.S. PATENT DOCUMENTS

| | | | | | |
|---|---|---|---|---|---|
| 3,874,101 | A * | 4/1975 | Cummins | E02F 3/081 | 198/493 |
| 3,902,448 | A * | 9/1975 | Davis | B63H 19/08 | 37/346 |
| 4,026,049 | A | 5/1977 | Johnson | | |
| 4,033,056 | A * | 7/1977 | Demmers | E02F 9/062 | 37/309 |
| 4,073,078 | A * | 2/1978 | Leitz | E02F 3/905 | 114/294 |
| 4,334,587 | A | 6/1982 | Rangaswamy | | |
| 4,342,164 | A * | 8/1982 | Claassen | E02F 3/907 | 37/309 |
| 4,374,420 | A * | 2/1983 | Wolters | E02F 3/907 | 37/308 |
| 4,399,623 | A * | 8/1983 | Neumann | B63B 21/50 | 37/308 |
| 4,470,209 | A | 9/1984 | Proehl | | |
| 4,473,256 | A * | 9/1984 | Collins | E02B 17/024 | 173/28 |
| 5,145,425 | A * | 9/1992 | Little | E02F 9/062 | 37/346 |
| 5,311,682 | A * | 5/1994 | Sturdivant | E02F 3/88 | 37/312 |
| 5,778,568 | A * | 7/1998 | Toyoshima | E02F 3/081 | 37/338 |
| 5,791,074 | A * | 8/1998 | Pryor | B63B 21/50 | 37/312 |
| 7,900,381 | B2 | 3/2011 | Clymans | | |
| 2015/0084647 | A1 | 3/2015 | De Poorter et al. | | |
| 2015/0167273 | A1* | 6/2015 | Graaff | E02F 3/06 | 37/342 |
| 2018/0112373 | A1* | 4/2018 | Hout | B63H 19/08 | |

* cited by examiner

DREDGE WALKING SPUD APPARATUS

CROSS-REFERENCE TO RELATED APPLICATIONS

This application claims the benefit of and/or priority to U.S. Provisional Patent Application Ser. No. 62/266,400, filed 11 Dec. 2015, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to dredges or barges, and dredge or barge spud arrangements. More particularly, the present invention relates to an improved dredge or barge spud and spud carriage arrangement that supports a carriage preferably in between inner and outer frame members, wherein links on the frame members preferably attach to the carriage in an improved configuration that preferably enables a power source (e.g., hydraulic cylinder) to move the links and the carriage from a forward position to a rear position relative to the dredge or dredge hull, thus preferably enabling dredge hull movement when the spuds are anchored to a water bottom, seabed, river bottom or the like.

2. General Background of the Invention

Dredges and barges employ a floating hull that can be held in position with elongated piling or "spuds". These spuds can be elevated or lowered. When elevated, the dredge or barge can be moved to a new location. When lowered, the spuds embed in a water bottom to anchor the barge or dredge at a selected location. Some spuds are "walking" spuds in that the spuds can be moved relative to the hull when the spuds are in the lowered, anchoring position. These walking spuds thus enable some movement of the hull even when the spuds are in the lowered, anchoring position.

Patents have issued that are directed to spud arrangements including walking spuds. The following table lists some examples. Each patent in the table is hereby incorporated herein by reference.

TABLE

| Pat. No. | Title | Issued |
|---|---|---|
| 7,900,381 | Apparatus with Flexibly Mounted Spud Carriage | Mar. 8, 2011 |
| 5,791,074 | Dredge | Aug. 11, 1998 |
| 4,470,209 | Dredge Swinging Apparatus | Sep. 11, 1984 |
| 4,399,623 | Dredges | Aug. 23, 1983 |
| 4,033,056 | Spud Guide Means in a Dredging Vessel | Jul. 5, 1977 |
| 4,334,587 | Offset Walking Spud | Jun. 15, 1982 |
| 4,026,049 | Articulating Dredge | May 31, 1977 |
| 2,850,814 | Hydraulic Mechanism for Dredge | Sep. 9, 1958 |
| 2,917,851 | Spud Construction for Dredges | Dec. 22, 1959 |
| 2,290,118 | Walking Mechanism | Aug. 28, 1941 |
| 2015/0084647 | Vessel Comprising Spud | Mar. 26, 2015 |

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation, which may be made without departing in any way from the spirit of the present invention. No feature of the invention is critical or essential unless it is expressly stated as being "critical" or "essential."

BRIEF SUMMARY OF THE INVENTION

The present invention provides a barge or dredge and spud apparatus of improved configuration. The apparatus provides a barge or dredge preferably having a hull or floating tank. The barge or hull preferably supports one or more spuds. Preferably, an interface mounts each spud to the hull. The interface preferably includes a frame attached to the hull and a carriage supported by the frame for movement between a forward position and a rear position. The carriage can preferably be moved from the forward position to the rear position (or from the rear position to the forward position) in order to preferably change position of the hull or floating tank relative to the spuds, when the spuds, are anchored to the water bed, sea bed, lake bed, river bed, etc.

In one embodiment, a pair of inside links span between the frame and the carriage.

In one embodiment, a pair of outside links span between the frame and the carriage.

In one embodiment, a power source connects to and moves at least one link between first and second positions.

In one embodiment, the carriage is positioned in between the inside links and the outside links.

In one embodiment, each link is connected at a link upper end portion to the frame.

In one embodiment, each link is connected at a link lower end position to the carriage.

In one embodiment, the carriage provides an open ended bore that holds the spud.

In one embodiment, a lift mechanism enables a raising or lowering of each spud wherein the spud moves in the open ended bore when being raised or lowered.

In one embodiment, the power source is a hydraulic cylinder.

In one embodiment, the lift mechanism is a winch and winch cable, the cable rigged to the spud.

In one embodiment, the lift mechanism is a hydraulic cylinder mounted to the carriage to the spud.

In one embodiment, each link is pivotally connected to the carriage.

In one embodiment, each link is pivotally connected to the frame.

In one embodiment, the carriage has a lower end portion with a fitting and each link attaches to the fitting.

In one embodiment, the frame includes an inner frame member, an outer frame member and a plurality of spacer beams that each span between the inner frame member and the outer frame member.

In one embodiment, the inner frame member is mounted (e.g., welded) to the hull.

In one embodiment, pins connect each link to another link and to the carriage.

In one embodiment, a hull and spud apparatus can comprise a hull, one or more spuds, an interface that mounts each spud to the hull, the interface including a frame attached to the hull and a carriage supported by the frame for movement between a forward position and a rear position, a pair of inside links that span between the frame and the carriage, a power source that moves at least one said link between first and second positions, wherein the carriage is positioned in between the inside links and the outside links, wherein each link is connected at a link upper end portion to the frame, wherein each link is connected at a link lower end portion to the carriage, the carriage having an open ended bore that holds the spud, and a lift mechanism that enable a raising or lowering of each spud wherein the spud moves in said open ended bore when being raised or lowered.

In one embodiment, the power source is a hydraulic cylinder.

In one embodiment, the lift mechanism is a winch and winch cable, the cable rigged to the spud.

In one embodiment, the lift mechanism is a hydraulic cylinder mounted to the carriage and to the spud.

In one embodiment, each link is pivotally connected to the carriage.

In one embodiment, each link is pivotally connected to the frame.

In one embodiment, the carriage has a lower end portion with a fitting and each link attaches to the fitting.

In one embodiment, the frame includes an inner frame member, an outer frame member and a plurality of spacer beams that each span between the inner frame member and the outer frame member.

In one embodiment, the inner frame member is mounted to the hull.

In one embodiment, lower pins connect each link to another link and to the carriage.

In one embodiment, the hull supports one or more dredge components.

In one embodiment, a hull and spud apparatus can comprise a buoyant hull having a periphery, a plurality of spuds attached to the hull at the periphery, an interface that mounts each spud to the hull, the interface including a frame attached to the hull and a carriage supported by the frame for movement between a forward carriage position and a rear carriage position, a plurality of links that span between the frame and the carriage, the links including inside links and outside links, a power source that moves at least one said link between first and second positions, wherein the carriage is positioned in between the inside links and the outside links, wherein each link is connected at a link upper end portion to the frame, wherein each link is connected at a link lower end portion to the carriage, the carriage having an open ended bore that holds the spud, a lift mechanism that enables a raising or lowering of each spud wherein the spud moves in said open ended bore when being raised or lowered, and wherein movement of the links moves the carriage and spud relative to the hull in a lateral direction.

In one embodiment, the power source is a cylinder and pushrod.

In one embodiment, the lift mechanism is a winch and winch cable rigged to the carriage and spud.

In one embodiment, the lift mechanism is a cylinder and pushrod mounted to the carriage and to the spud.

In one embodiment, each link is pivotally connected to the carriage.

In one embodiment, each link is pivotally connected to the frame.

In one embodiment, the carriage has a lower end portion with a fitting and each link attaches to the fitting.

In one embodiment, the frame includes an inner frame member, an outer frame member and a plurality of spacers that span between the inner frame member and the outer frame member.

In one embodiment, the inner frame member is welded or bolted to the hull.

In one embodiment, lower pins connect each link to another link and to the carriage.

In one embodiment, the hull supports one or more dredge components.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2:
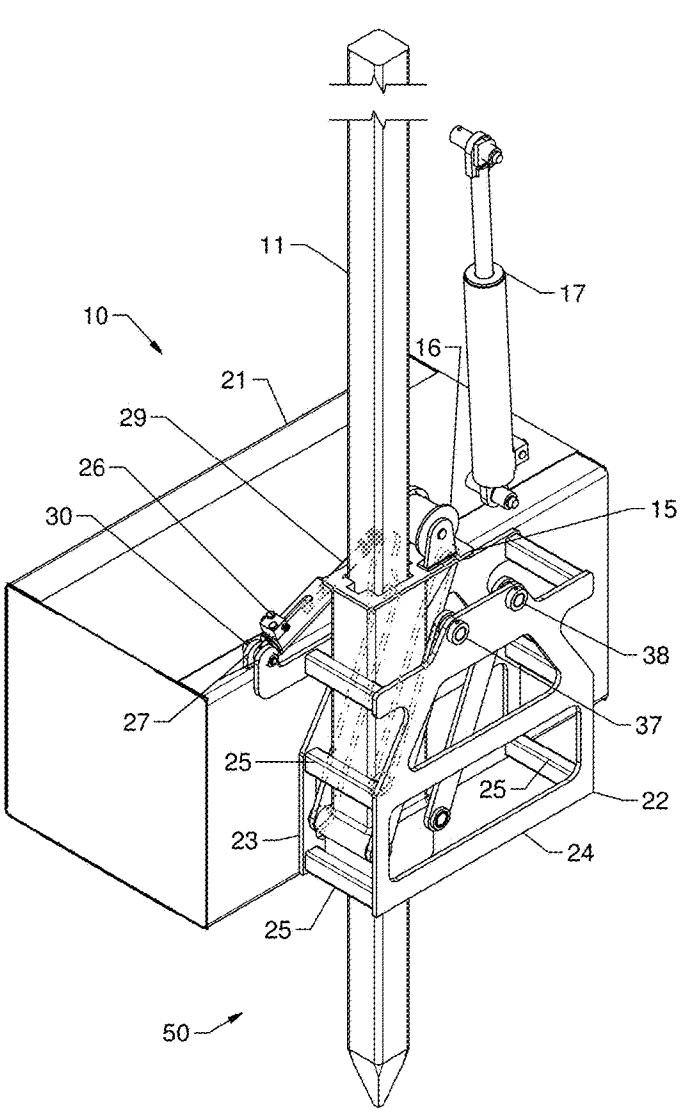
FIG. 2 is a perspective view of a preferred embodiment of the apparatus of the present invention.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

FIGS. 1-5 show the preferred embodiments of the apparatus of the present invention, designated generally by the numeral 10. Dredge or barge apparatus 10 is preferably in the form of a floating hull or tank 21. The tank or hull 21 is only shown in partial size in FIGS. 1-3. It should be understood that the hull or tank 21 could be a barge like hull arrangement as seen for example, in FIG. 5. For a dredge, the hull or tank 21 preferably carries usual dredge components such as a pilot house 55, and engine/pump 56. Hull or tank 21 also preferably supports a plurality of spuds 11. In one embodiment, hull or tank 21 supports at least one spud 11 (see FIGS. 1-4). Each spud 11 is preferably an elongated structural member that may be elevated for dredge travel and lowered to and into the water bottom when the dredge 10 is anchored to a selected locale. The spuds 11 can preferably be elevated or lowered using a winch 16 and cable 53 (see FIG. 4), or by other means such as, for example, a hydraulic cylinder and pushrod 17.

The dredge apparatus 10 of an embodiment of the present invention provides a walking spud arrangement in that each spud 11 can preferably be moved relative to the hull 21 even when the spuds 11 are in a lowered or anchoring position. The hull 21 can preferably be moved a distance when a spud 11 remains embedded in the seabed or water bottom, river bed or lake bed.

Figure 5:
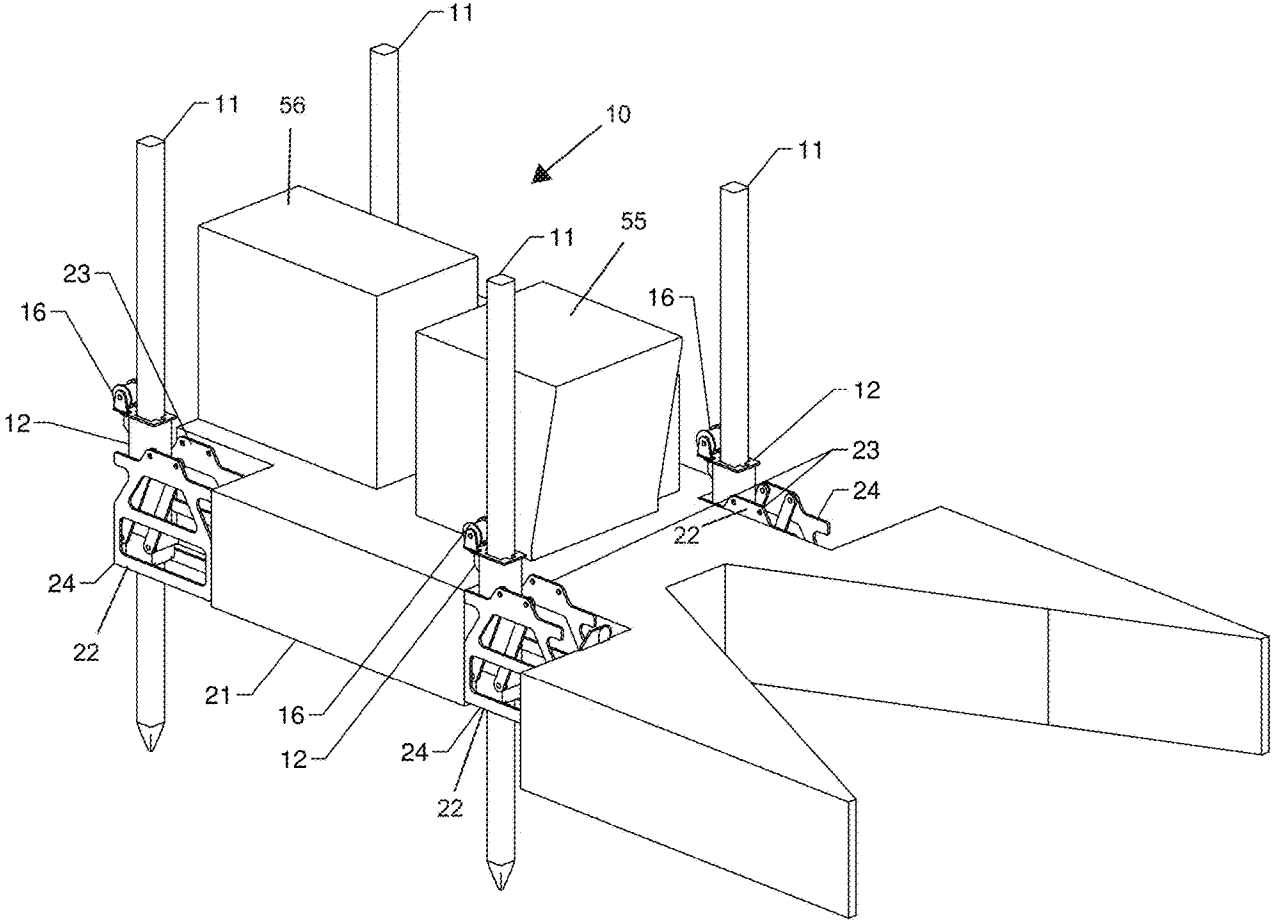
FIG. 5 is a perspective view of a preferred embodiment of the apparatus of the present invention illustrating a plurality of spuds on a hull or tank of the dredge or barge apparatus.

In the embodiment as shown in FIG. 5 a plurality of spuds 11 are provided on hull 21, wherein each spud 11 can preferably be moved relative to the hull 21 even when one or more, or all of the spuds 11 are in a lowered or anchoring position. In a walking spud arrangement, the hull 21 can preferably be moved a distance when one or more, or all of the spuds 11 remain embedded in the seabed or water bottom, river bed or lake bed.

Each spud 11 is preferably generally vertically oriented or inclined and supported by carriage 12. Carriage 12 preferably has upper end 13 and lower end 14. At upper end 13, plate 15 can be preferably mounted on or attached to (e.g., welded) carriage 12. Lift winch 16 can be preferably attached to plate 15. Lift winch 16 preferably has a cable 53 rigged to spud 11. Operation of winch 16 (and cable 53) preferably enables elevation or lowering of spud 11. A lift cylinder 17 can optionally be provided for raising or lowering spud 11.

Carriage 12 preferably has an open ended bore 51 that is receptive of spud 11. At the lower end of carriage 12 is attached (e.g., welded) a fitting 18. Fitting 18 preferably has front opening or openings 19 and rear opening or openings 20. These openings 19, 20 are preferably receptive of pins 43, 44 that preferably form connections with links 31, 33, and 47, 48.

Figure 1:
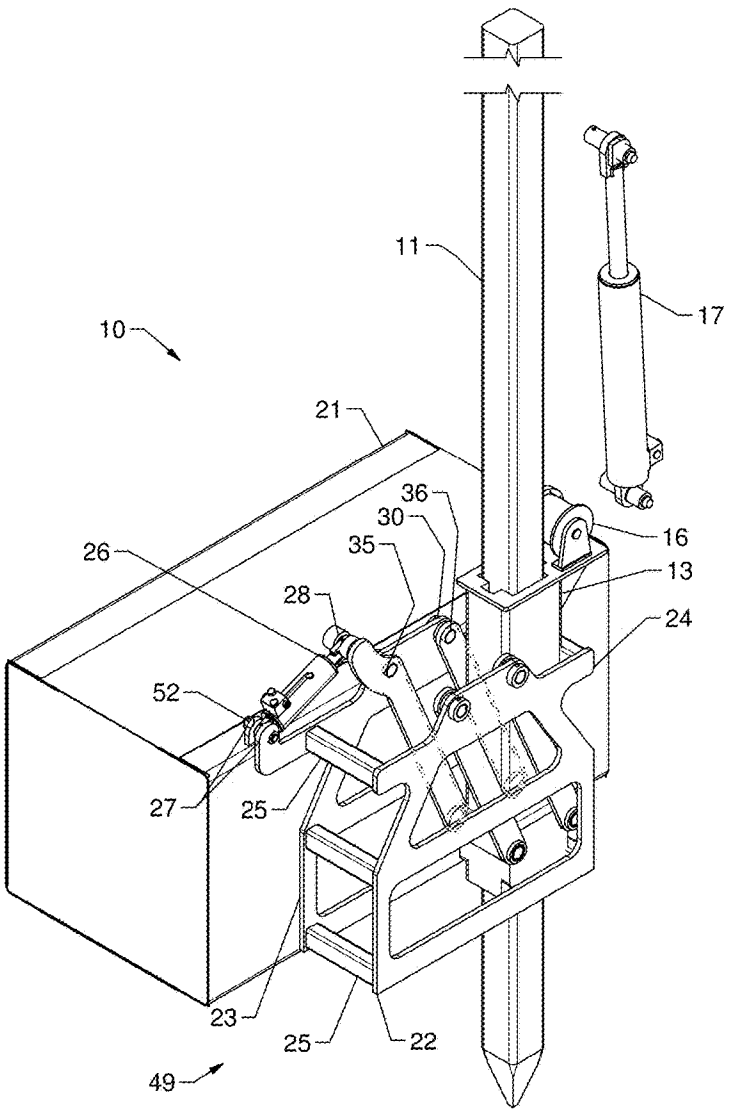
FIG. 1 is a perspective view of a preferred embodiment of the apparatus of the present invention.

Links 31, 33 and 47, 48 preferably form a linkage for connecting carriage 12 fitting 18 to frame or carriage containment 22 (see FIGS. 1-2). The frame or carriage containment 22 preferably includes inner frame member 23 and outer frame member 24. Outer frame member 24 is preferably attached to inner frame member 23 with a plurality of spacers/beams 25. Frame/carriage containment 22 can be of a welded steel construction, for example or of other of suitable materials.

A power source such as hydraulic cylinder 26 is preferably provided for moving a carriage 12 (and a contained spud 11) relative to hull 21. Hydraulic cylinder 26 is preferably attached to one of the inside links such as link 31. FIGS. 1-4 show an embodiment of the present invention where the cylinder 26 attaches at its end portions to gussets/plates 27 on inner frame member 23 and to rear inside link 31.

FIG. 1 shows an embodiment of the present invention wherein pinned connection 28 joins pushrod 29 of cylinder 26 to link 31. Pinned connection 52 joins cylinder 26 to plates or gussets 27. Pinned connection 28 uses a pin 39 and bushing 40 to join link 31 to inner frame member 23 at opening 32. Pinned connection 30 uses another pin 39 and bushing 40 to join link 33 to inner frame member 23, wherein an opening 34 in inner frame member 23 is receptive of a said top pin 39.

The pins 39 and bushings 40 preferably pivotally join links 31 and 33 to the inner frame member 23. Rear inside pivot 35 is provided to pivotally attach link 31 to the inside frame member 23. A front inside pivot 36 is provided to pivotally attach link 33 to the inside frame member 23.

Rear outside pivot 38 pivotally attaches link 47 to the outside frame member 24. Front outside pivot 37 pivotally attaches link 48 to outside frame member 24. Rear outside pivot 37 includes a top outside pin 41 and bushing 42. Front outside pivot 38 also includes a pin 41 and bushing 42.

Pivotal connections preferably join the lower end of each link 31, 33, 47, 48 to fitting 18. These pivotal connections preferably use pins 43, 44 and bushings 45, 46 as well as openings 19, 20 in fitting 18.

In FIG. 1, carriage 12 and spud 11 are in a first position 49 (which can also be a forward position). FIG. 2 shows carriage 12 and spud 11 in a second position 50 (which can also be a rearward position). FIG. 1 also shows that the hydraulic cylinder 26 is retracted. FIG. 2 shows that pushrod 29 has been extended. In various embodiments, the dredge 10 may have a plurality of spuds 11 (e.g., three, four, or more spuds).

Figure 3:
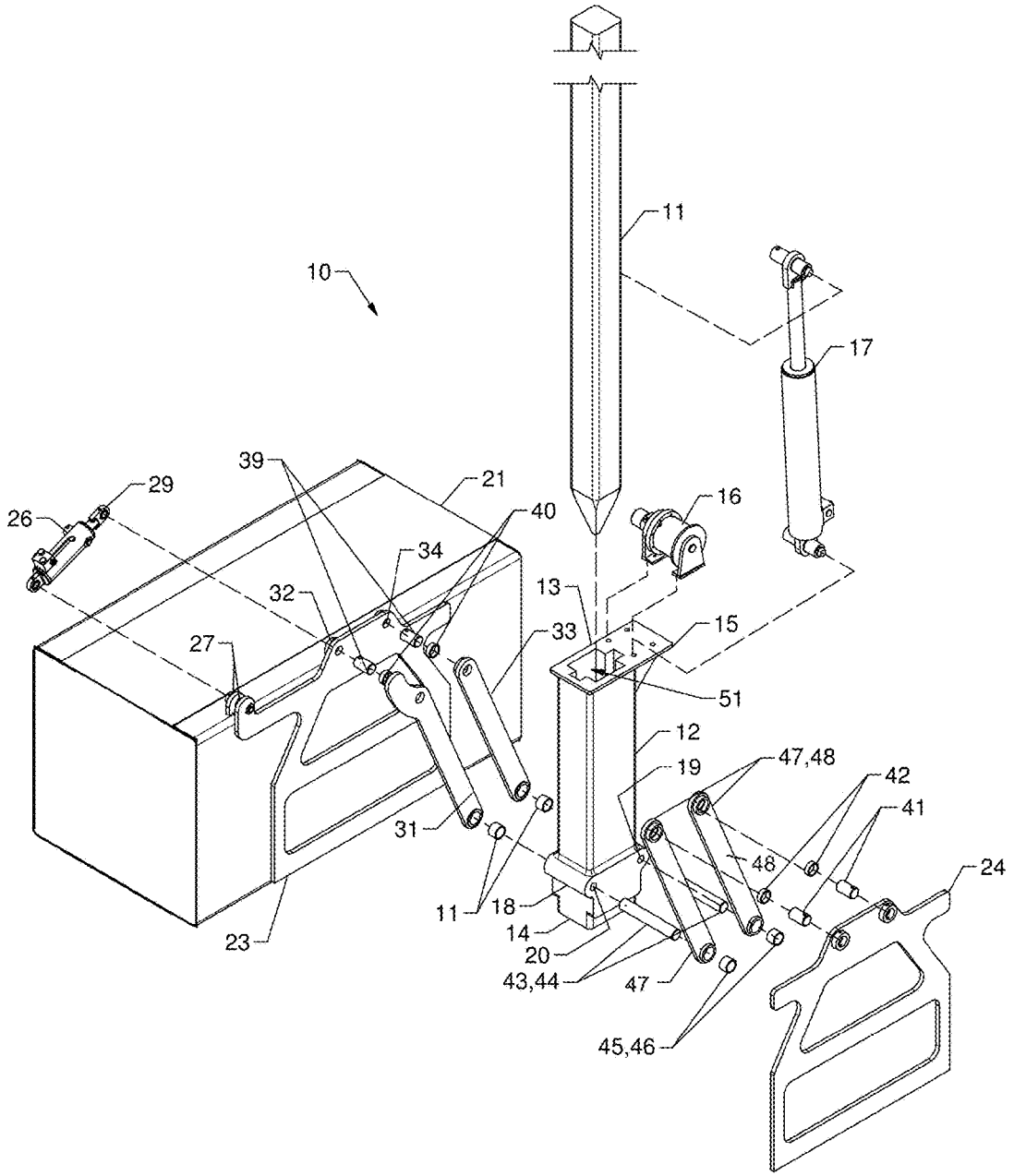
FIG. 3 is an exploded view of a preferred embodiment of the apparatus of the present invention.
Figure 4:
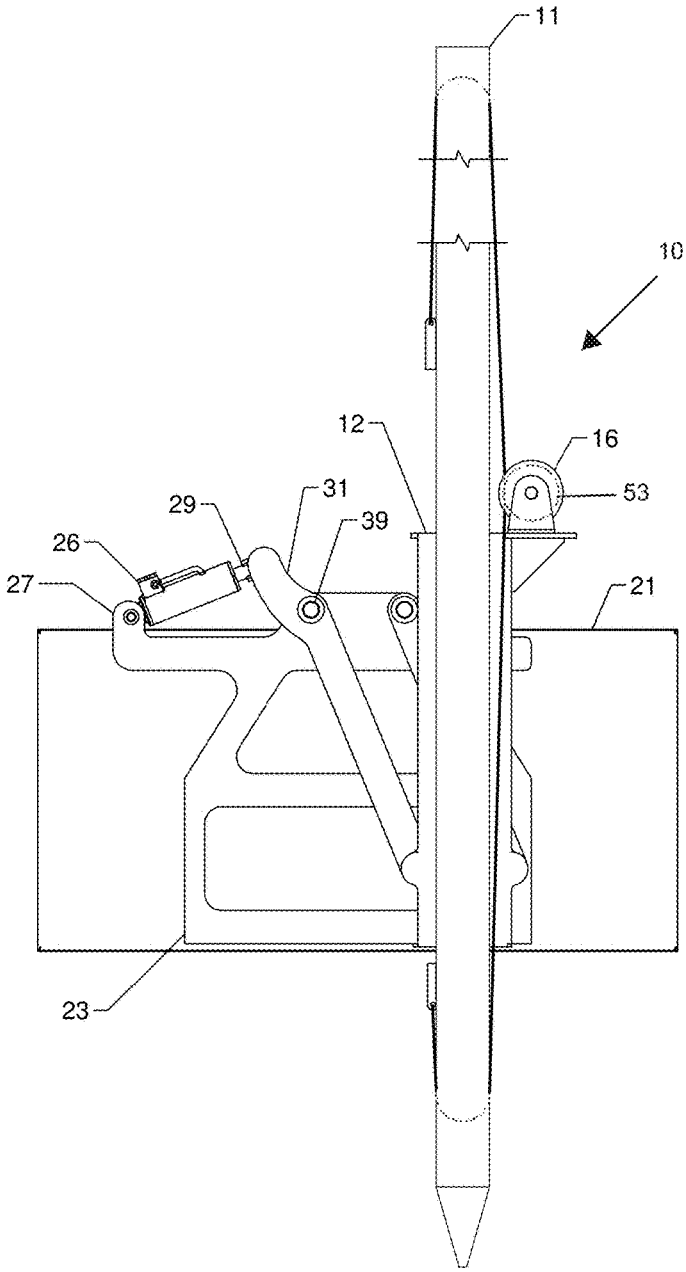
FIG. 4 is a side view of a preferred embodiment of the apparatus of the present invention.

As shown in FIG. 5, in various embodiments, each spud 11 could have a carriage 12 and frame 22 arrangement employing the linkage and connectors as shown in the embodiment of FIGS. 1-3. FIG. 5 shows an embodiment of a dredge 10, having hull, barge, or tank 21 and four (4) spuds 11. A pilot house 55 and engine/pump 56 is also shown. In other embodiments a dredge 10 can have more or less than four (4) spuds 11.

The following is a list of parts and materials suitable for use in the present invention:

PARTS LIST:

| PART NUMBER | DESCRIPTION |
|---|---|
| 10 | dredge/barge apparatus |
| 11 | spud |
| 12 | carriage |
| 13 | upper end |
| 14 | lower end |
| 15 | plate |
| 16 | lift winch/winch and cable |
| 17 | lift cylinder/cylinder and pushrod |
| 18 | fitting |
| 19 | opening/front |
| 20 | opening/rear |
| 21 | floating hull/tank/barge |
| 22 | frame/carriage containment |
| 23 | inner frame member |
| 24 | outer frame member |
| 25 | spacer/beam |
| 26 | hydraulic cylinder |
| 27 | gussets/plates |
| 28 | pinned connection |
| 29 | pushrod |
| 30 | pinned connection |
| 31 | rear inside link |
| 32 | opening |
| 33 | front inside link |
| 34 | opening |
| 35 | link pivot - rear inside |
| 36 | link pivot - front inside |
| 37 | link pivot - rear outside |
| 38 | link pivot - front outside |
| 39 | top pin, inside |
| 40 | top bushing - inside |
| 41 | top pin, outside |
| 42 | top bushing, outside |
| 43 | bottom pin, front |
| 44 | bottom pin, rear |
| 45 | bottom bushing, front |
| 46 | bottom bushing, rear |
| 47 | front outside link |
| 48 | rear outside link |
| 49 | first position |
| 50 | second position |
| 51 | bore |
| 52 | pinned connection |
| 53 | cable |
| 55 | pilot house |
| 56 | engine/pump |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A hull and spud apparatus comprising:

a) a hull;

b) one or more spuds;

c) an interface that mounts each spud to the hull;

d) the interface including a frame attached to the hull and a carriage supported by the frame for movement between a forward position and a rear position;

e) a plurality of links that span between the frame and the carriage, including a pair of inside links and a pair of outside links;

f) a power source that moves at least one said link between first and second positions;

g) wherein each spud is positioned in between a pair of said inside links and a pair of said outside links;

h) wherein each link is connected at a link upper end portion to the frame;

i) wherein each link is connected at a link lower end portion to the carriage;

j) the carriage having an open ended bore that holds the spud;

k) a lift mechanism that enables a raising or lowering of each spud relative to the hull, wherein the spud moves in said open ended bore when being raised or lowered;

l) wherein in said first position the spud is moved in a horizontal direction in front of at least one said link upper end portion; and m) wherein in said second position, the spud is moved in a horizontal direction to a position behind at least one said link upper end portion.

2. The hull and spud apparatus of claim 1 wherein the power source is a hydraulic cylinder.

3. The hull and spud apparatus of claim 1 wherein the lift mechanism is a winch and winch cable, the winch cable rigged to the spud.

4. The hull and spud apparatus of claim 1 wherein the lift mechanism is a hydraulic cylinder mounted to the carriage and to the spud.

5. The hull and spud apparatus of claim 1 wherein each link is pivotally connected to the carriage.

6. The hull and spud apparatus of claim 1 wherein each link is pivotally connected to the frame.

7. The hull and spud apparatus of claim 1 wherein the carriage has a lower end portion with a fitting and each link attaches to the fitting.

8. The hull and spud apparatus of claim 1 wherein the frame includes an inner frame member, an outer frame member and a plurality of spacer beams that each span between the inner frame member and the outer frame member.

9. The hull and spud apparatus of claim 8 wherein the inner frame member is mounted to the hull.

10. The hull and spud apparatus of claim 6 wherein lower pins connect each link to another link and to the carriage.

11. A hull and spud apparatus comprising:

a) a buoyant hull;

b) a plurality of spuds attached to the hull with an interface;

c) said interface including a frame attached to the hull having frame front and frame rear portions and a carriage supported by the frame for movement between a forward carriage position nearer to the frame front portion and a rear carriage position nearer to said frame rear portion;

d) a plurality of links that span between the frame and the carriage the links including inside links and outside links;

e) a power source that moves at least one said link between a first forward position and a second aft position;

f) wherein the spud is positioned in between the inside links and the outside links;

g) wherein each link is connected at a link upper pivotal connection to the frame;

h) wherein each link is connected at a link lower end portion to the carriage;

i) the carriage having an open ended bore that holds the spud;

j) lift mechanisms that enables a raising or lowering of each said spud relative to the hull, wherein the spud moves in said open ended bore when being raised or lowered;

k) wherein movement of the links moves the carriage and spud relative to the hull, between said forward carriage position and said rear carriage position;

l) wherein in said first forward position the spud is positioned in front of at least one said pivotal upper connection; and m) wherein in said second aft position the spud is positioned behind at least one said pivotal upper connection.

12. The hull and spud apparatus of claim 11 wherein the power source is a cylinder and pushrod.

13. The hull and spud apparatus of claim 11 wherein the lift mechanism is a winch and winch cable rigged to the carriage and spud.

14. The hull and spud apparatus of claim 11 wherein the lift mechanism is a cylinder and pushrod mounted to the carriage and to the spud.

15. The hull and spud apparatus of claim 11 wherein each link is pivotally connected to the carriage.

16. The hull and spud apparatus of claim 11 wherein each link is pivotally connected to the frame.

17. The hull and spud apparatus of claim 11 wherein the carriage has a lower end portion with a fitting and each link attaches to the fitting.

18. The hull and spud apparatus of claim 11 wherein the frame includes an inner frame member, an outer frame member and a plurality of spacers that span between the inner frame member and the outer frame member.

19. The hull and spud apparatus of claim 18 wherein the inner frame member is welded or bolted to the hull.

20. The hull and spud apparatus of claim 16 wherein lower pins connect each link to another link and to the carriage.

21. The apparatus of claim 1 wherein the hull supports one or more dredge components.

22. The apparatus of claim 11 wherein the hull supports one or more dredge components.

* * * * *